US005465976A

United States Patent [19]

Gonzalez

[11] Patent Number: 5,465,976

[45] Date of Patent: Nov. 14, 1995

[54] GAMEPIECE WITH PROTECTOR

[75] Inventor: Mark A. Gonzalez, Plano, Tex.

[73] Assignee: MGwhiz, Inc., Plano, Tex.

[21] Appl. No.: 358,478

[22] Filed: Dec. 19, 1994

[51] Int. Cl.[6] ..... A63F 9/00

[52] U.S. Cl. ..... 273/317; 273/288; 273/353; 273/428

[58] Field of Search ..... 273/94, 288, 353, 273/157 R, 317, 428; 434/345

[56] References Cited

U.S. PATENT DOCUMENTS

| | | | |
|---|---|---|---|
| 1,085,405 | 1/1914 | Dadd | 434/345 |
| 1,735,456 | 11/1929 | Garman | 434/345 |
| 3,100,642 | 8/1963 | Goldstein | 273/157 R X |
| 4,733,867 | 3/1988 | Kemp et al. | 273/94 |
| 5,110,127 | 5/1992 | Potter | 273/94 X |
| 5,186,461 | 2/1993 | Tucker | 273/94 |
| 5,257,783 | 11/1993 | Callaghan | 273/94 X |

OTHER PUBLICATIONS

"Star Trek The Next Generation Space Caps" Series—copyright 1994 by Playmates Toys (Hong Kong) Ltd.

*Primary Examiner*—William H. Grieb
*Attorney, Agent, or Firm*—Fulbright & Jaworski

[57] ABSTRACT

A substantially planar elliptical gamepiece with one or more indentations provided in the outer perimeter thereof. The position of an indentation is predetermined so that a finger flick, when applied to the indentation, is likely to propel the gamepiece with optimum height, length and accuracy. A substantially planar protector is also disclosed, with a hole provided to receive the gamepiece therein for storage when not in use. When the gamepiece is received into the protector, a substantially continuous common planar surface is formed, suitable for imposing collectable and tradeable images thereon by printing or other means.

14 Claims, 2 Drawing Sheets

GAMEPIECE WITH PROTECTOR

BACKGROUND OF THE INVENTION

Adults and children alike have amused themselves for years by propelling projectile-like gamepieces through the air with finger flicks, with the objective of achieving superior height, distance or accuracy. As this recreational pastime has developed, games using the finger flick technique have emerged to simulate well-known sports such as football, basketball and others. Recent U.S. Patents disclosing variations on this pastime include Callaghan, U.S. Pat. No. 5,257,783; Potter, U.S. Pat. No. 5,110,127; and Tucker, U.S. Pat. No. 5,186,461.

Experience in propelling a planar gamepiece through the air with a finger flick has shown that once a basic proficiency is mastered, considerable skill is required to consistently launch the gamepiece into a long, high and straight trajectory. Experimentation has revealed that the best results are typically achieved when the gamepiece is held generally upright with a planar axis pointing in the desired direction of travel. The finger flick should then be applied to the perimeter of the gamepiece at a predetermined position below the equator.

The present invention is therefore directed to a substantially planar gamepiece whose outer perimeter has one or more indentations. These indentations are located at predetermined positions on the outer perimeter so that a finger flick, when applied to the indentation, is likely to propel the gamepiece with optimum trajectory. The indentations may also be curved so as to approximate the curvature of a fingernail. In this way, the fingernail, when engaged in the indentation, will make improved contact with the outer perimeter of the gamepiece and thereby increase the chances of achieving optimum trajectory.

The preferred embodiment disclosed herein is directed to an elliptical gamepiece. Flicking this elliptical gamepiece is intended to simulate kicking a football. It will be understood, however, that the present invention is not limited to elliptical-shaped gamepieces.

The present invention also discloses a protector for the gamepiece. Clearly, it is important to minimize damage to the outer perimeter of the gamepiece in order to prolong its accurate flying life. To this end, the preferred embodiment discloses a substantially planar protector providing a hole of suitable perimeter for receiving the gamepiece and storing it when not in use.

This concept of matching a gamepiece with a protector produces new and unexpected results. When a substantially planar gamepiece is received into a substantially planar protector, the gamepiece stored inside the protector provides a common planar surface. This common planar surface is suitable to be printed with collectable and tradeable images. Further, gamepieces as printed may be interchanged with various protectors bearing other printed images. As a result, gamepieces and protectors may be collected, interchanged and traded to bring added recreational value to the basic object of achieving levels of skill in flicking the gamepieces.

SUMMARY OF THE INVENTION

It is an object of this invention to create a game of skill that requires the player to propel a gamepiece through the air by means of a finger flick on the outer perimeter thereof, wherein an indentation in the outer perimeter will suggest to the player a point at which the impact of the finger flick is most likely to propel the gamepiece with optimum trajectory.

It is a further object of this invention to protect the outer perimeter of the gamepiece when not in use by providing a protector with a void into which the gamepiece may be received and stored snugly.

It is a further object of this invention to create a game of skill that is easy and inexpensive to manufacture, and that may be played almost anywhere.

It is another object of this invention to provide the basis for a collectable and tradeable series of reproductions thereof. The preferred embodiment hereof provides a substantially continuous planar surface when the gamepiece is received into the protector onto which a collectable and tradeable image can then be fixed by printing or other means. The part-image on the gamepiece may then be separated from the part-image on the protector to allow multiple part-images to be interchangeable, thereby adding a further dimension to the collectable and tradeable aspects of the present invention.

These and other objects of the present invention will be apparent to those skilled in this art from the detailed description of a preferred embodiment of the invention set forth below.

BRIEF DESCRIPTION OF THE DRAWINGS

This invention will be further described in connection with the accompanying drawings, in which.

DETAILED DESCRIPTION OF THE INVENTION

Figure 1:
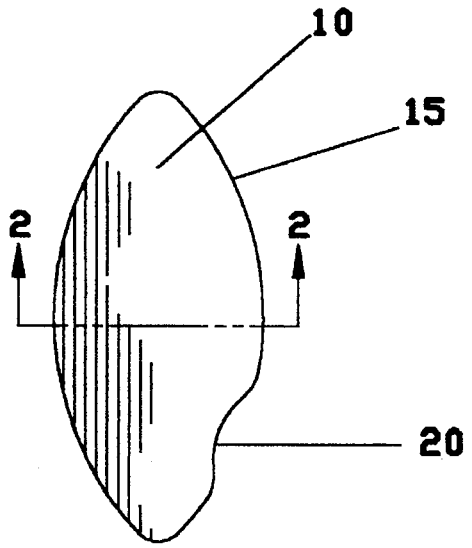
FIG. 1 is an elevation view of gamepiece 10, disclosing indentation 20 in outer perimeter 15.
Figure 2:
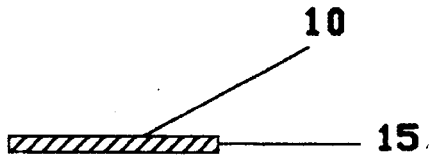
FIG. 2 is a sectional view through gamepiece 10 as shown on FIG. 1.
Figure 5:
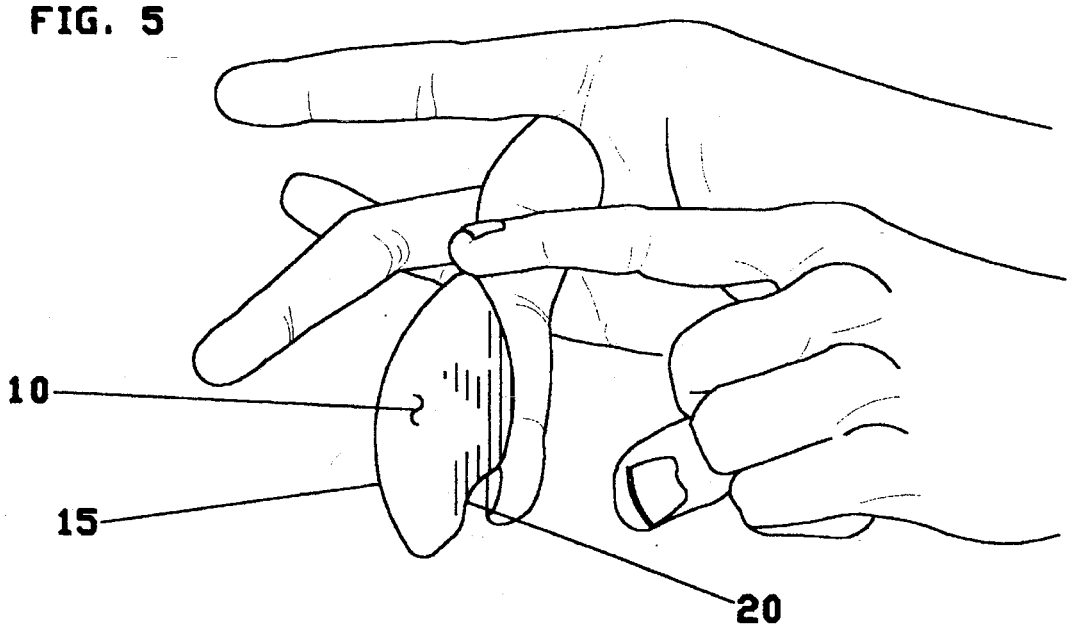
FIG. 5 is a perspective view showing gamepiece 10 in use, at the moment of impact by a finger flick. Indentation 20 is receiving the fingernail.

Referring to FIG. 1 and FIG. 2, gamepiece 10 is substantially planar and has an outer perimeter 15 of substantially elliptical shape. Outer perimeter 15 has an indentation 20 provided therein. As shown in FIG. 5, gamepiece 10 is propelled through the air by holding gamepiece 10 upright and applying a finger flick to outer perimeter 15. Also as shown on FIG. 5, the position of indentation 20 is predetermined to mark the location on outer perimeter 15 at which the impact of the fingernail is most likely to propel the gamepiece with optimum trajectory.

Figure 3:
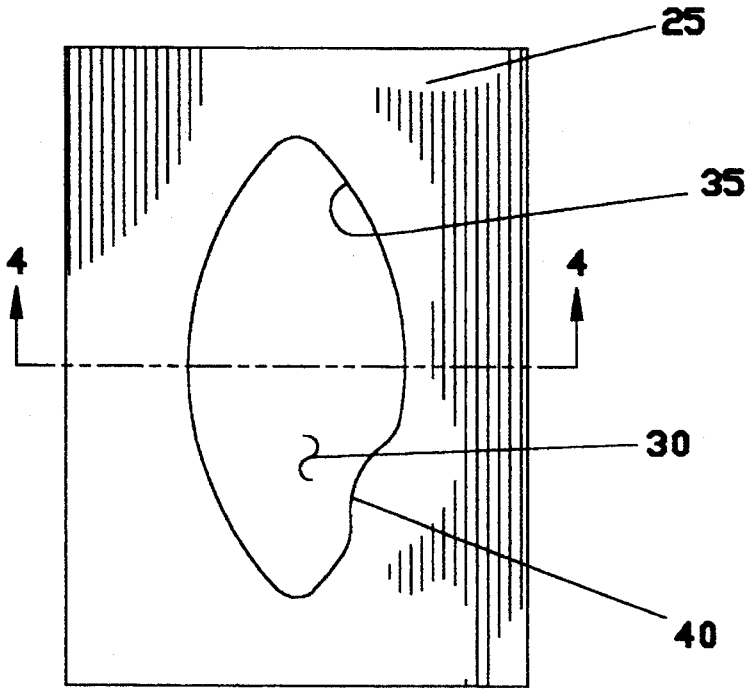
FIG. 3 is an elevation view of protector 25, disclosing hole 30 and protrusion 40 in inner perimeter 35.
Figure 4:
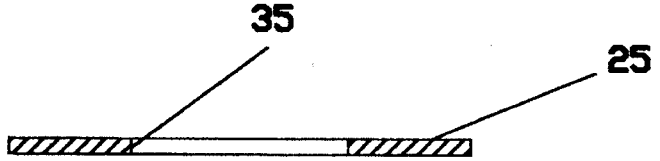
FIG. 4 is a sectional view through protector 25 as shown on FIG. 3.
Figure 6:
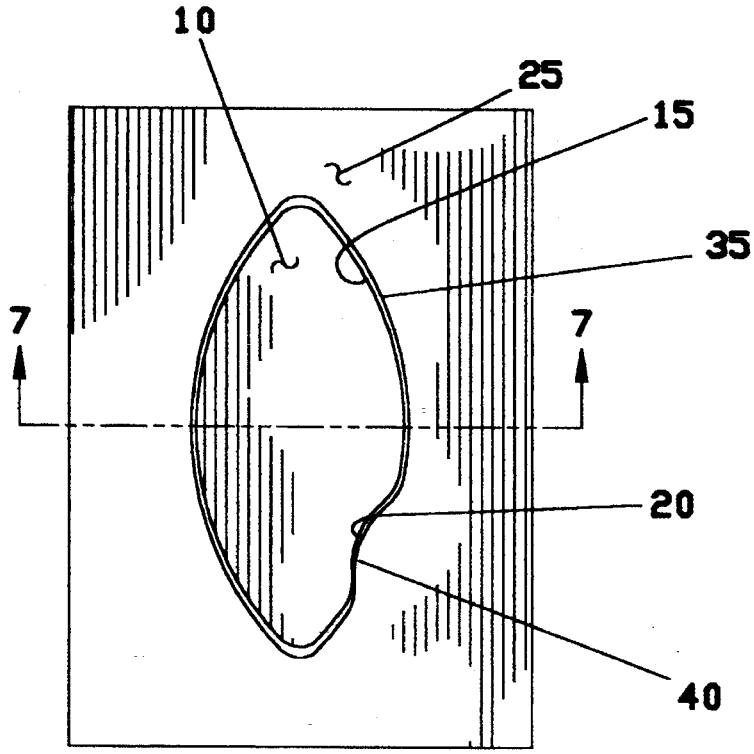
FIG. 6 is an elevation view showing gamepiece 10 received into protector 25 when not in use.

Referring now to FIG. 3 and FIG. 4, protector 25 is also substantially planar, and provides a substantially elliptical hole 30 therein. Hole 30 has an inner perimeter 35 with a protrusion 40 therein extending towards hole 30. As shown on FIG. 6, the size and shape of inner perimeter 35 is predetermined to match substantially the size and shape of outer perimeter 15 of gamepiece 10, so that gamepiece 10 fits snugly when received into hole 30, and indentation 20 cooperates with protrusion 40.

Figure 7:
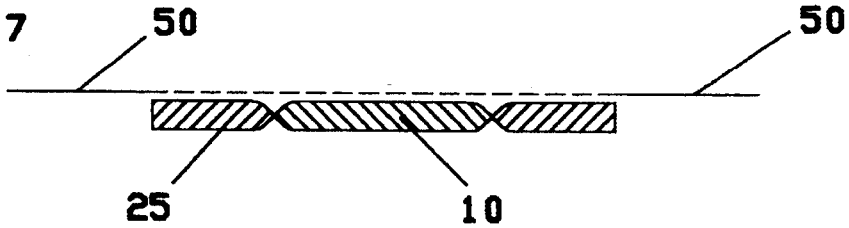
FIG. 7 is a sectional view as shown in FIG. 6.

Referring now to FIG. 7, it will be seen that when gamepiece 10 is received into protector 25, a substantially continuous common planar surface 50 is provided, suitable for receiving collectable and tradeable images by printing or other means.

Although the foregoing preferred embodiment discloses a substantially elliptical gamepiece protected by a substantially planar protector with a hole therethrough, it will be understood that the present invention is not limited to such constraints of shape. For example, the gamepiece could take on other shapes, again with an indentation provided in the outer perimeter to mark the point at which a finger flick is most likely to propel with optimum trajectory. Further, the protector could be of any three-dimensional shape with a void therein to receive and protect the gamepiece. Moreover, instead of being a hole, the void in the protector could also be a recess extending only partially through the protector.

The invention has been shown, described and illustrated in substantial detail with reference to a presently preferred embodiment. However, it will be understood by those skilled in the art that changes and modifications may be made without departing from the spirit and scope of the invention which is defined by the claims set forth hereunder.

I claim:

1. A gamepiece, comprising:

a substantially planar gamepiece, the gamepiece having an outer perimeter, the outer perimeter being of substantially elliptical shape, the substantially elliptical shape of the outer perimeter having two vertices; and the outer perimeter also having at least one indentation therein, the indentations being located at predetermined positions around the outer perimeter, the predetermined positions of the indentations around the outer perimeter being selected so that the gamepiece flies with optimum loft and accuracy when the gamepiece is stood upright on one of the two vertices and a blow is struck to one of the indentations;

whereby the accuracy of propelling the gamepiece through the air may be enhanced by striking one of the indentations in the gamepiece's outer perimeter.

2. The gamepiece of claim 1, further comprising:

a substantially planar protector, the protector providing a hole, the hole having an inner perimeter, the size and shape of the inner perimeter substantially matching the size and shape of the outer perimeter of the gamepiece, the inner perimeter also providing at least one protrusion therein extending towards the hole, the number of protrusions matching the number of indentations in the outer perimeter of the gamepiece, the shape of the protrusions and the position of the protrusions around the inner perimeter predetermined to cooperate with the indentations when the gamepiece is received into the hole;

whereby the gamepiece may be received into the hole in the protector and stored therein when not in use.

3. The gamepiece of claim 2, further comprising:

a substantially continuous common planar surface formed across the gamepiece and the protector when the gamepiece is received into the hole.

4. A gamepiece, comprising:

a substantially planar gamepiece, the gamepiece having an outer perimeter, the outer perimeter being of a predetermined shape, the outer perimeter also having at least one indentation therein, the indentations being located at predetermined positions around the outer perimeter, the predetermined positions of the indentations around the outer perimeter being selected so that the gamepiece flies with optimum loft and accuracy when the gamepiece is stood upright and a blow is struck to one of the indentations;

whereby the accuracy of propelling the gamepiece through the air may be enhanced by striking an indentation in the gamepiece's outer perimeter.

5. The gamepiece of claim 4, further comprising:

a solid protector of predetermined shape, the solid protector having a void therein, the void having an inner perimeter, the size and shape of the inner perimeter substantially matching the size and shape of the outer perimeter of the gamepiece, the inner perimeter also providing at least one protrusion therein extending towards the void, the number of protrusions matching the number of indentations in the outer perimeter of the gamepiece, the shape of the protrusions and the position of the protrusions around the inner perimeter predetermined to cooperate with the indentations when the gamepiece is received into the void;

whereby the gamepiece may be received into the void and stored therein when not in use.

6. The gamepiece of claim 5, further comprising:

a substantially continuous common planar surface formed across the gamepiece and the protector when the gamepiece is received into the void.

7. The gamepiece of claim 5, wherein the shapes of the outer perimeter of the gamepiece and of the inner perimeter of the void are substantially elliptical.

8. The gamepiece of claim 6, wherein the shapes of the outer perimeter of the gamepiece and of the inner perimeter of the void are substantially elliptical.

9. The gamepiece of claim 5, wherein the solid protector is substantially planar in shape.

10. The gamepiece of claim 6, wherein the solid protector is substantially planar in shape.

11. The gamepiece of claim 5, wherein the void is a hole through the solid protector.

12. The gamepiece of claim 6, wherein the void is a hole through the solid protector.

13. The gamepiece of claim 5, wherein the void is a recess extending only partially through the solid protector.

14. The gamepiece of claim 6, wherein the void is a recess extending only partially through the solid protector.

* * * * *